US007975481B2

(12) United States Patent
Grieser et al.

(10) Patent No.: US 7,975,481 B2
(45) Date of Patent: Jul. 12, 2011

(54) METHOD AND APPARATUS FOR CONTROLLING A STEAM CYCLE

(75) Inventors: Jens Grieser, Söhnstetten (DE); Christian Bausch, Bubesheim (DE)

(73) Assignee: Voith Patent GmbH, Heidenheim (DE)

( * ) Notice: Subject to any disclaimer, the term of this patent is extended or adjusted under 35 U.S.C. 154(b) by 424 days.

(21) Appl. No.: 12/144,835

(22) Filed: Jun. 24, 2008

(65) Prior Publication Data

US 2009/0013692 A1 Jan. 15, 2009

(30) Foreign Application Priority Data

Jul. 10, 2007 (DE) ..... 10 2007 032 437

(51) Int. Cl.
*F01K 23/10* (2006.01)

(52) U.S. Cl. ..... 60/618; 60/646; 60/651

(58) Field of Classification Search ..... 60/618, 60/646, 657, 651
See application file for complete search history.

(56) References Cited

U.S. PATENT DOCUMENTS

| | | | | |
|---|---|---|---|---|
| 3,888,084 | A * | 6/1975 | Hawkins | 60/618 |
| 4,020,637 | A | 5/1977 | Izumi | |
| 4,471,622 | A * | 9/1984 | Kuwahara | 60/667 |
| 4,573,323 | A | 3/1986 | Mock | |
| 4,586,338 | A * | 5/1986 | Barrett et al. | 60/618 |
| 6,174,151 | B1 * | 1/2001 | Yarr | 418/171 |
| 6,829,894 | B2 * | 12/2004 | Bloch et al. | 60/646 |
| 2002/0007636 | A1 * | 1/2002 | Hay | 60/618 |

FOREIGN PATENT DOCUMENTS

DE 102 29 250 11/2007

* cited by examiner

*Primary Examiner* — Mary A Davis
(74) *Attorney, Agent, or Firm* — Baker & Daniels LLP

(57) ABSTRACT

The invention relates to a steam cycle apparatus, comprising a reservoir for a liquid operating medium;

an evaporator in which the operating medium is evaporator by supply of heat, with the vaporous operating medium being supplied to an expander for expansion and for performing mechanical work and subsequently being liquefied in a condenser which is in connection with a reservoir;

an operating medium pump for supplying operating medium from the reservoir to a feed line to the evaporator;

a feedback control unit (7) for the operating medium flow;

characterized in that the operating medium pump comprises a bypass line which produces a connection between the input side of the operating medium pump and the output side of the operating medium pump, with a controlled overflow valve being arranged in the bypass line whose control element is triggered by the feedback control unit for the operating medium flow for regulating the pressure and/or volume flow of the operating medium in the feed line to the evaporator.

12 Claims, 2 Drawing Sheets

METHOD AND APPARATUS FOR CONTROLLING A STEAM CYCLE

A method and apparatus for controlling a steam cycle, especially a steam cycle apparatus which forms a part of a vehicle drive.

Steam cycle processes such as a Clausius-Rankine process for generating mechanical power from a heat flow are known and can be driven for example by a separate burner unit in a combined heat-and-power device. For motor vehicles, steam cycle apparatuses are preferably used for utilizing waste heat of an internal combustion engine, with either the cooling water flow of the internal combustion engine or preferably its exhaust flow being used as heat source depending on the choice of the operating medium and the temperature guidance of the steam cycle.

For controlling the power of steam cycles, a regulation of the volume flow of the operating medium to the evaporator is proposed by DE 102 29 250 A1. This requires an operating medium pump with variable conveying volume in order to set a predetermined volume flow and/or pressure set point for the operating medium in the feed line to the evaporator. In order to realize this requirement, a variable-speed drive can be assigned to the operating medium pump, thus requiring an electromotor for an electrically driven pump. This is disadvantageous for a vehicle drive however due to the required mounting space. Moreover, it represents an additional electric consumer. If the steam cycle apparatus is the part of a vehicle drive with an internal combustion engine, the operating medium pump can be driven alternatively by means of a control coupling in a variable-speed manner by the internal combustion engine. Such a solution is complex from a constructional standpoint and requires mounting space for the additional control coupling.

Further controls for the volume flow of the operating medium in the feed line to the evaporator are known from U.S. Pat. No. 4,573,323 and U.S. Pat. No. 4,020,637. The first specification discloses an arrangement of several pumps which remove operating medium from a reservoir or an intermediate container which is arranged between an evaporator and a superheater for the vapor phase of the operating medium. One of these pumps is arranged as a controllable injector pump which is provided upstream of a pump driven at a constant speed whose conveying volume is a function of the pressure difference between input and output side. Depending on the setting of the injector pump, operating medium is supplied either from the intermediate container or the reservoir to the subsequent pump. With this apparatus which is provided especially for starting operations of the steam cycle it is not possible to precisely adjust the volume flow of the operating medium to the evaporator within the terms of power control for the steam cycle.

A steam cycle apparatus is known from the above mentioned U.S. Pat. No. 4,020,637 which is driven by a burner unit. A portion of the mechanical power generated in the expander is used for driving pumps for the operating medium to the evaporator and for fuel supply to the burner unit. As a result of this measure, there is a balance between the power output at the expander and the necessary steam supply in normal operations, which balance depends on the pressure in the operating medium line and the burner temperature. If a disturbance occurs in this balance, valves in the bypass lines in the pumps are opened which allow a recirculation of the operating medium or the fuel to the pump input side. The valves in the bypass lines act as directional control valves, which means as switches which can assume an on-state and an off-state. Moreover, there are throttle positions in the bypass lines in order to maintain the pressure difference in the pump. Through the arrangement of the disclosed bypass lines, merely a pressure peak is removed in the case of opening of the bypass line, so that the disclosed apparatus does not allow for any regulation of the volume flow and/or the pressure of the operating medium in the feed line to the evaporator along a setpoint curve. Instead, the above described measures are merely made in the case of excess pressure. The same applies to the pump device in the feed line to the burner.

The invention is based on the object of providing a steam cycle apparatus and an operating method for the same which allows omitting a separate engine for the operating medium pump which can be set in a variable-speed manner, especially for applications in a drive apparatus for a motor vehicle, and still variably arranging the conveying volume of the operating medium supplied to the evaporator for the purpose of power adjustment, or setting the pressure of the operating medium in the feed line to the evaporator according to a target specification. An apparatus is sought which is simple in respect of construction and production and in the case of errors leads to defined pressure settings in the steam cycle device and moreover works in a highly energy-efficient way.

This object is achieved by the features of the independent claims. The apparatus in accordance with the invention comprises a bypass line to the operating medium pump in which a controlled overflow valve is arranged. This overflow valve is triggered by a feedback control unit for the operating medium flow and allows a continuous recirculation from the output side of the operating medium pump to its input side, whose volume flow, starting from a target specification for the volume flow of the operating medium and/or the pressure in the feed line to the evaporator.

A needle valve which is set by means of a motive unit such as a stepper motor can be used as a controlled overflow valve. An embodiment of the invention is preferred however in which an externally controlled pressure-limiting valve is used as controlled overflow valve. Said externally controlled pressure-limiting valve is subjected to a control pressure in an especially preferred way which is generated by a pressure-reducing valve whose pressure on the output side is set by means of an electromagnetic actuating unit. A constant feed pressure is used for feeding the pressure-reducing valve which is generated by a pressure-maintaining valve fed from the feed line to the evaporator. It is thus possible to omit a feed pump for the control line and to simultaneously generate the high control pressures that are necessary for triggering the control element of the externally controlled pressure-limiting valve in the bypass line.

A further advantage of such an embodiment is that in the case of an error the system will assume defined control positions. Moreover, it can be operated in an energy-efficient way and allows a compact design that saves mounting space. Moreover, standardized hydraulic components can be used.

The steam cycle apparatus in accordance with the invention allows driving an operating medium pump for supplying operating medium to the evaporator with a drive speed which can be chosen independent of the necessary volume flow and independent of the pressure setpoint value in the feed line to the evaporator. A pump is preferably chosen as an operating medium pump whose conveying flow is proportional to the drive speed, which means that gear pumps or especially internal-gear pumps can be considered. The operating medium pump is preferably driven directly, which means that a separate drive motor for the pump is omitted. Instead, the operating medium pump is connected at least indirectly with an output shaft of the internal combustion engine in the case of an integration of the steam cycle apparatus in a vehicle drive with an internal combustion engine. Gear or coupling units can be interposed. It is not necessary in accordance with the invention however to provide an apparatus with which the drive speed of the operating medium pump is set to a specific value dependent upon the necessary volume flow in the feed line to the evaporator.

The recirculation of the operating medium in the bypass line to the input side of the operating medium pump preferably occurs in such a way that the reservoir for the operating medium is delimited against the bypass line by means of a non-return valve in order to increase the pumping efficiency of the operating medium pump. In addition or alternatively, an injector pump can be used instead of a non-return valve which comprises a Venturi tube.

An embodiment is further preferable in which the recirculation of the operating medium from the pump output side to the input side occurs by means of the bypass line via the reservoir, which means that the bypass line opens into the reservoir. The reason for this measure is that as a result of the continual re-pumping the power loss of the pump leads to a heating of the operating medium circulating through the pump and the bypass line. The thermal buffer of the reservoir is used in order to limit this heating so that evaporation of the operating medium is securely excluded. Instead of a through-flow of the reservoir, an embodiment can be chosen in which the bypass line is guided through the reservoir, which means that the operating medium that is under a relatively high pressure remains in the bypass line, with heat being guided to the operating medium in the reservoir as a result of the path of the bypass line leading through the reservoir. According to a further embodiment, the bypass line opens in the Venturi tube of an injector pump in the reservoir, so that the energy of the pressurized operating medium in the bypass line is used for supplying operating medium from the reservoir to the input side of the actual operating medium pump.

A further advantageous embodiment provides in the bypass line a filter for the operating medium, with said filter preferably being arranged on the output side relative to the controlled overflow valve. A further pressure-limiting valve is provided for safety reasons in the steam cycle apparatus, which valve securely removes operating medium to the reservoir in the event of exceeding the maximum system pressure. According to an advantageous embodiment, said overpressure safety valve is provided between expander and condenser according to an advantageous embodiment.

It is also possible to branch off a portion of the operating medium to an injector pump from the feed line to the evaporator, which pump is arranged on the output side to the condenser. An increase in the efficiency of the steam cycle apparatus can thus be achieved, with the injector pump which is preferably arranged on the output side to the condenser being arranged in a controllable manner.

The invention is now explained in closer detail by reference to embodiments as shown in the drawings, wherein the drawings show in detail:

Figure 1:
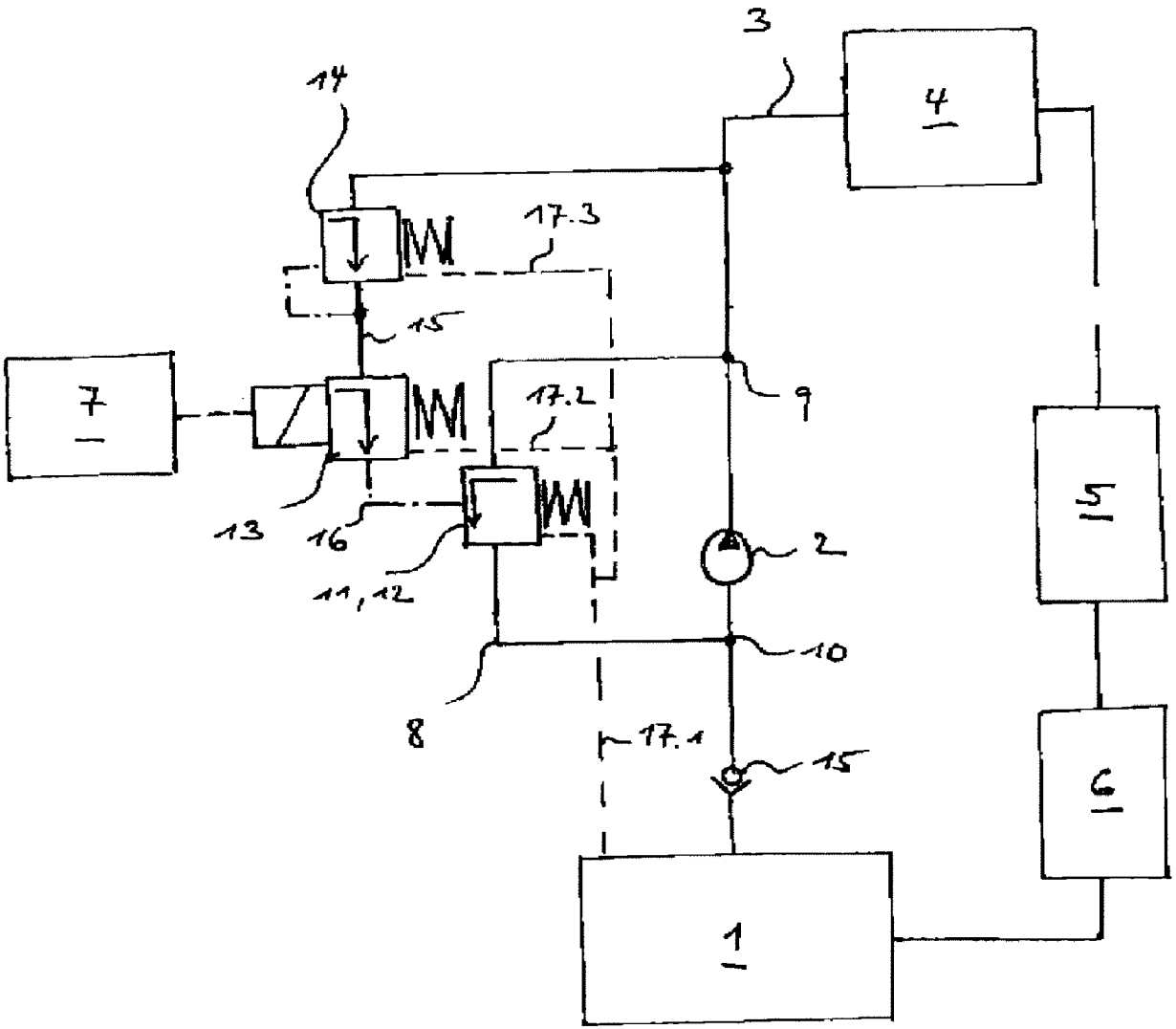
FIG. 1 shows a schematically simplified view of an embodiment of a steam cycle apparatus in accordance with the invention.

FIG. 1 shows a schematically simplified view of the basic components of a steam cycle apparatus. Fluid operating medium is pumped from a reservoir 1 by means of an operating-medium pump 2 in a feed line 3 to the evaporator 4. The evaporation of the operating medium occurs in the evaporator 4, with the thermal energy required for this purpose being supplied from a burner unit that is not shown here in closer detail. The steam cycle apparatus is especially preferably a part of a vehicle drive with an internal combustion engine whose waste heat heats the evaporator 4. The exhaust gases of an internal combustion engine are considered especially in this case, with the components required for this purpose not being shown in detail in FIG. 1 for the purpose of simplifying the illustration. Evaporator 4 can be arranged in several stages. A superheating unit can especially be provided for the vapor phase. The vapor phase of the operating medium is supplied by the evaporator 4 to the expander 5 in which it performs mechanical work under expansion. After the expander 5, the operating medium is liquefied in the condenser 6 and returned to the reservoir 1.

An internal-gear pump is preferably used as an operating medium pump 2 whose speed is set independent of the volume flow requirement in the feed line to the evaporator 3. According to a first embodiment, the operating medium pump 2 is operated by a separate motive unit with constant speed, so that it acts substantially as a constant pump. According to a preferred embodiment, the separate motive unit for driving the operating medium pump is omitted and is driven directly instead, with a rigid connection especially being provided, optionally via an interposed gear with a rigid gear transmission ratio to the shaft of an internal combustion engine. Alternatively, this connection can be produced by means of a switch coupling. The components for driving the operating medium pump 2 are not shown in detail in FIG. 1.

In accordance with the invention, a bypass line 8 is provided between the output side 9 of the operating medium pump 2 and the input side 10 of the operating medium pump 2, in which a continual recirculation occurs in normal operation whose volume flow is set by means of a controlled overflow valve. In the illustrated embodiment, an externally controlled pressure-limiting valve 12 is used as a controlled overflow valve 11. The control of the externally controlled pressure-limiting valve 12 occurs through the control pressure line 16, to which a control pressure is given for a preferred embodiment by means of an externally controlled pressure-reducing valve 13. The externally controlled pressure-reducing valve 13 is supplied by a pressure-maintaining valve 14 which is in connection with the evaporator feed line 3 and which provides a constant pressure in the feed pressure line 15. The pressure setting on the control pressure line 16 occurs by means of an electromagnetic actuating element on the externally controlled pressure-reducing valve 13 whose setting is determined by a feedback control unit 7 for the operating medium flow. This feedback control unit 7 for the operating medium flow uses signals from sensors (not shown in FIG. 1) which measure pressure and/or the volume flow in the feed line 3 to the evaporator 4. Accordingly, the volume flow in the bypass line 8 is regulated in such a way that the volume flow and/or the pressure progression follows a predetermined set curve in the feed line to the evaporator 4 which is obtained from the performance requirements at expander 5. The feedback control unit 7 for the operating medium flow can be arranged as an autonomous control/feedback control unit or be integrated in a superset vehicle control system. The further line connections shown in FIG. 1 for the operating medium represent leakage current lines 17.1, 17.2 and 17.3 of the above mentioned pressure lines.

Figure 2:
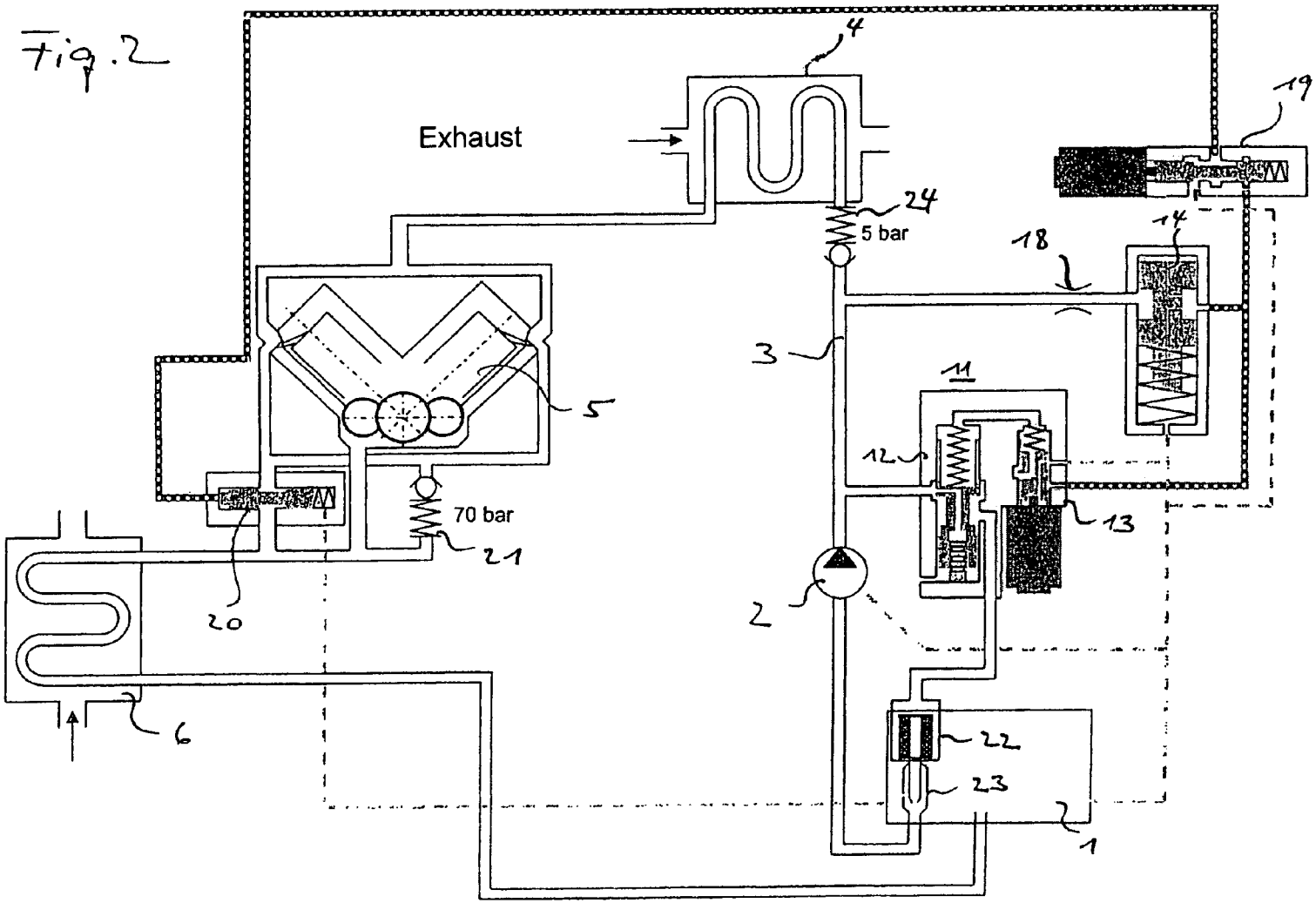
FIG. 2 shows a further embodiment of a steam cycle apparatus in accordance with the invention.

FIG. 2 shows a further embodiment of a steam cycle apparatus in accordance with the invention, with the same reference numerals as in FIG. 1 being used for coinciding components. For the illustrated embodiment, the bypass line 8 opens into reservoir 1 for the operating medium, with a filter 22 being provided for the operating medium at the end on the discharge side of the bypass line 8. Bypass line 8 further opens within the reservoir 1 in the Venturi tube of an injector pump 23. In such an embodiment it is possible to utilize a portion of the energy of the pressurized operating medium in the bypass line 8 for supplying operating medium from the reservoir 1 to the operating medium pump 2 and to ensure its secure filling. When an internal-gear pump is used as an operating medium pump 2, its conveying volume is substantially proportional to rotating speed, with any undesirable evaporation of the operating medium in the operating medium pump 2 and in the bypass line 8 being securely prevented by the illustrated supply of operating medium from reservoir 1 to the operating medium pump 2 even in the case that the operating medium pump 2 has reached its operating temperature. This follows from the cooling effect which results from the supply of the bypass line 8 to the reservoir. According to an alternative embodiment (not shown), the bypass line 8 can be brought into thermal contact with the reservoir 1 without producing a hydraulic connection. In this case, the bypass line 8 is separated from the reservoir 1 by means of a non-return valve on the input side of the operating medium pump 9. This is not shown in detail in FIG. 2.

For the embodiment as shown in FIG. 2, a non-return valve is provided before the evaporator 24 in the feed line to the evaporator 3. It is provided with a flat valve characteristic which is used to set a defined build-up pressure which needs to be exceeded in order to enable an incoming flow to the evaporator 4. Moreover, evaporator 4 is separated from the feed line to the evaporator 3 in case of a fault. The non-return valve 24 before the evaporator can be set to a build-up pressure of 5 bar at an operating medium pressure in the feed line to the evaporator in the range of 20 to 60 bar.

FIG. 2 further shows further hydraulic control elements which are used for controlling the expander 5. The main control valve 20 is associated with a pilot valve 19 which produces the required control pressure, with the feed of the pilot valve 19 occurring according to an advantageous embodiment again via the pressure-maintaining valve 14 which is also used for feeding the externally controlled pressure-reducing valve 13 for controlling the externally controlled pressure-limiting valve 12 in the bypass line 8.

A safety valve 21 is provided as a further component in the steam cycle apparatus which is arranged between the expander 5 and the condenser 6 for the embodiment shown in FIG. 2 in order to ensure the discharge of operating medium to the reservoir 1 via the condenser 6 in which a liquefying occurs upon exceeding the maximum system pressure, which in the present embodiment is 70 bar.

Further embodiments of the invention which comprise a bypass line 8 with a volume-flow-controlled or pressure-controlled overflow valve are obtained from the scope of protection of the following claims.

| List of reference numerals | |
|---|---|
| 1 | Reservoir |
| 2 | Operating medium pump |
| 3 | Feed line to evaporator |
| 4 | Evaporator |
| 5 | Expander |
| 6 | Condenser |
| 7 | Feedback control unit for operating medium flow |
| 8 | Bypass line |
| 9 | Output side of operating medium pump |
| 10 | Input side of operating medium pump |
| 11 | Controlled overflow valve |
| 12 | Externally controlled pressure-limiting valve |
| 13 | Externally controlled pressure-reducing valve |

-continued

| List of reference numerals | |
|---|---|
| 14 | Pressure-maintaining valve |
| 15 | Feed pressure line |
| 16 | Control pressure line |
| 17.1,17.2, 17.3 | Leakage current lines |
| 18 | Throttle |
| 19 | Pilot valve |
| 20 | Main control valve |
| 21 | Safety valve |
| 22 | Filter |
| 23 | Injector pump |
| 24 | Non-return valve before evaporator |

The invention claimed is:

1. A steam cycle apparatus, comprising:

a reservoir for a liquid operating medium; an evaporator in which liquid operating medium is evaporated by the supply of heat thereto;

an expander to which the vaporous operating medium is supplied for expansion and for performing mechanical work;

a condenser to which the operating medium is then supplied for liquefaction, the condenser fluidly connected to the reservoir;

an operating medium pump for supplying operating medium from the reservoir to a feed line fluidly connected to the reservoir, a bypass line forming a connection between input and output sides of the operating medium pump;

a feedback control unit for operating medium flow;

an externally controlled pressure-limiting overflow valve arranged in the bypass line and having a control element controlled by the feedback control unit for regulating pressure and/or volume flow of the operating medium in the feed line to the evaporator; and a pressure-reducing valve externally controlled by means of an electromagnetic control unit, the control element of the externally controlled pressure-limiting overflow valve subjected to a control pressure by the pressure reducing valve.

2. A steam cycle apparatus according to claim 1, further comprises comprising a pressure-maintaining valve which is supplied by the feed line to the evaporator and generates a constant feed pressure for the externally controlled pressure-reducing valve.

3. A steam cycle apparatus according to claim 1, wherein the bypass line comprises on its outlet side an injector pump which draws in operating medium from the reservoir and supplies operating medium to the input side of the operating medium pump.

4. A method for controlling the steam cycle apparatus according to claim 3, wherein the conveying volume flow of the operating medium pump is set independent of a setpoint value for the pressure and/or the volume flow of the operating medium in the feed line to the evaporator and the feedback control unit for the operating medium flow controls a continuous return flow of operating medium through the bypass line to the input side of the operating pump depending on a target specification for the pressure and/or the volume flow of the operating medium in the feed line to the evaporator.

5. A steam cycle apparatus according to claim 1, wherein the bypass line opens into the reservoir or passes through the reservoir.

6. A steam cycle apparatus according to claim 1, including a filter for the operating medium arranged in the bypass line.

7. A steam cycle apparatus according to claim 1, wherein the feed line to the evaporator comprises a non-return valve which is used for setting a minimum pressure for the inflow of operating medium to the evaporator.

8. A method for controlling the steam cycle apparatus according to claim 7, wherein the conveying volume flow of the operating medium pump is set independent of a setpoint value for the pressure and/or the volume flow of the operating medium in the feed line to the evaporator and the feedback control unit for the operating medium flow controls a continuous return flow of operating medium through the bypass line to the input side of the operating pump depending on a target specification for the pressure and/or the volume flow of the operating medium in the feed line to the evaporator.

9. A steam cycle apparatus according to claim 1, wherein the externally controlled pressure-limiting overflow valve which is connected with the reservoir is used as a safety valve for setting the maximum system pressure.

10. A method for controlling the steam cycle apparatus according to claim 9, wherein the conveying volume flow of the operating medium pump is set independent of a setpoint value for the pressure and/or the volume flow of the operating medium in the feed line to the evaporator, and the feedback control unit for the operating medium flow controls a continuous return flow of operating medium through the bypass line to the input side of the operating pump depending on a target specification for the pressure and/or the volume flow of the operating medium in the feed line to the evaporator.

11. A drive unit for a vehicle, comprising a steam cycle apparatus according to claim 1; and means for supplying internal combustion engine exhaust gases to the evaporator.

12. A method for controlling a steam cycle apparatus, comprising:

providing a steam cycle apparatus including: a reservoir for a liquid operating medium; an evaporator in which liquid operating medium is evaporated by the supply of heat thereto; an expander to which the vaporous operating medium is supplied for expansion and for performing mechanical work; a condenser to which the operating medium is then supplied for liquefaction, the condenser fluidly connected to the reservoir; an operating medium pump for supplying operating medium from the reservoir to a feed line fluidly connected to the reservoir, a bypass line forming a connection between input and output sides of the operating medium pump; a feedback control unit for operating medium flow; an externally controlled pressure-limiting overflow valve arranged in the bypass line and having a control element controlled by the feedback control unit for regulating pressure and/or volume flow of the operating medium in the feed line to the evaporator; and a pressure-reducing valve externally controlled by means of an electromagnetic control unit, the control element of the externally controlled pressure-limiting overflow valve subjected to a control pressure by the pressure reducing valve;

setting the conveying volume flow of the operating medium pump independently of a set point value for the pressure and/or volume flow of the operating medium in the feed line to the evaporator; and controlling by means of the feedback control unit a continuous return flow of operating medium through the bypass line to the input side of the pump dependent on a target specification for the pressure and/or volume flow of the operating medium in the feed line to the evaporator.

* * * * *

UNITED STATES PATENT AND TRADEMARK OFFICE

CERTIFICATE OF CORRECTION

PATENT NO. : 7,975,481 B2
APPLICATION NO. : 12/144835
DATED : July 12, 2011
INVENTOR(S) : Jens Grieser et al.

It is certified that error appears in the above-identified patent and that said Letters Patent is hereby corrected as shown below:

Claim 2, Column 6, Line 45, delete "comprises"

Signed and Sealed this
Thirtieth Day of August, 2011

David J. Kappos

David J. Kappos
*Director of the United States Patent and Trademark Office*